US012806464B2

(12) United States Patent
Liao et al.

(10) Patent No.: US 12,806,464 B2
(45) Date of Patent: Nov. 24, 2026

(54) RESISTIVE FORCE MECHANISM

(71) Applicant: CHANG YOW TECHNOLOGIES INTERNATIONAL CO., LTD., Taichung City (TW)

(72) Inventors: Wei-Ting Liao, Taichung City (TW); Hui-Hung Hsieh, Taichung City (TW); Chia-Chien Hsu, Taichung City (TW)

(73) Assignee: CHANG YOW TECHNOLOGIES INTERNATIONAL CO., LTD., Taichung City (TW)

( * ) Notice: Subject to any disclaimer, the term of this patent is extended or adjusted under 35 U.S.C. 154(b) by 64 days.

(21) Appl. No.: 18/920,004

(22) Filed: Oct. 18, 2024

(65) Prior Publication Data

US 2026/0021339 A1 Jan. 22, 2026

(30) Foreign Application Priority Data

Jul. 19, 2024 (TW) ..... 113127144

(51) Int. Cl.
*A63B 21/00* (2006.01)

(52) U.S. Cl.
CPC ..... *A63B 21/154* (2013.01); *A63B 21/00069* (2013.01)

(58) Field of Classification Search
CPC ..... A63B 21/00058; A63B 21/00069; A63B 21/00072; A63B 21/00076; A63B 21/0058; A63B 21/153; A63B 21/154; A63B 21/155; A63B 21/22; A63B 21/4043; A63B 22/0046; A63B 23/12; A63B 24/0087; A63B 2225/09
See application file for complete search history.

(56) References Cited

U.S. PATENT DOCUMENTS 4,557,480 A * 12/1985 Dudley ..... A63B 21/1645 482/120
2002/0086777 A1* 7/2002 Charnitski ..... A63B 21/153 482/110
2024/0359045 A1* 10/2024 Hsu ..... A63B 21/0084
2024/0359050 A1* 10/2024 Hsu ..... A63B 21/0084
2025/0090886 A1* 3/2025 Simenthi ..... H02K 7/116
2025/0090893 A1* 3/2025 Simenthi ..... A63B 21/4035

FOREIGN PATENT DOCUMENTS

GB 2267224 A * 12/1993 ..... A63B 21/0087
WO WO-2018203311 A1 * 11/2018 ..... A63B 21/227

* cited by examiner

*Primary Examiner* — Gary D Urbiel Goldner
(74) *Attorney, Agent, or Firm* — MUNCY, GEISSLER, OLDS & LOWE, P.C.

(57) ABSTRACT

A resistive force mechanism includes a drive unit, and a reel for a pulling cord to be wound therearound. The resistive force mechanism is characterized in that the reel has an axle portion that is rotatable by being driven by the drive unit, a first base plate disposed on the axle portion, a second base plate disposed opposite to the first base plate, and a plurality of sliders annularly arranged around the axle portion and movably disposed between the first and second base plates for leaving or approaching the axle portion. As a result, the sliders collectively form a cylinder for the pulling cord to be wound therearound, and driven to leave or approach the axle portion of the reel to make a diameter of the cylinder increased or decreased, making the resistive force mechanism provide a resistive force of different magnitudes according to a moment arm of different magnitudes.

4 Claims, 19 Drawing Sheets

RESISTIVE FORCE MECHANISM

BACKGROUND OF THE INVENTION

1. Field of the Invention

The present invention relates to resistive force mechanisms and more particularly, to a resistive force mechanism applied to a fitness equipment and adjustable in resistive force according to the user's requirement.

2. Description of the Related Art

The traditional resistive force mechanism applied in a fitness equipment includes a motor, a reel connected with the motor, and a pulling cord wound around the reel. The reel is driven by the torque outputted by the motor to pull or release the pulling cord, so as to directly or indirectly provide appropriate resistive force to the user holding the pulling cord, making the user obtain exercise training.

Under the condition that the diameter of the reel is fixed (e.g. the diameter of the reel is 1 meter) and the torque outputted by the motor is fixed (e.g. 30 Newton-meters to 10 Newton-meters), because the torque is the result of multiplying the moment arm and the resistive force, the corresponding resistive force is 30 Newtons to 10 Newtons. When the user needs a relatively larger resistive force (e.g. 50 Newtons) for training, the original motor should be replaced by a relatively larger motor to provide a relatively larger torque (e.g. 80 Newton-meters to 40 Newton-meters) to correspond to the relatively larger resistive force. But the relatively larger motor cannot provide a relatively smaller torque (e.g. 20 Newton-meters) to correspond to a relatively smaller resistive force. On the contrary, when the user needs to use a relatively smaller resistive force (5 Newton-meters) for training, the original motor should be replaced by a relatively smaller motor to provide a relatively smaller torque (e.g. 10 Newton-meters to 5 Newton-meters), but the relatively smaller motor cannot provide a relatively larger torque (e.g. 40 Newton-meters) to correspond to a relatively smaller resistive force.

In other words, the traditional resistive force mechanism for a fitness equipment needs the replacement between differently sized motors for the adjustment of the resistive force to correspond to the user's requirement, or has to compromise with the outputted torque range of the motor, thereby very inconvenient in use. Therefore, the industry currently faces an issue that how to provide a resistive force mechanism for a fitness equipment, which is adjustable in resistive force according to the user's requirement and enlarged in outputted torque range without changing the specification of the motor.

SUMMARY OF THE INVENTION

The present invention has been accomplished in view of the above-noted circumstances. It is one of the objectives of the present invention to provide a resistive force mechanism which is applicable to a fitness equipment, equipped with a drive unit such as a motor, and adjustable in resistive force according to the user's requirement to result in enlarged resistive force adjustment range.

To attain the above objective, the present invention provides a resistive force mechanism which includes a drive unit, and a reel for a pulling cord to be wound therearound. The resistive force mechanism is characterized in that the reel has an axle portion which is rotatable by being driven by the drive unit, a first base plate disposed on the axle portion, a second base plate disposed opposite to the first base plate, and a plurality of sliders. The sliders are annularly arranged around the axle portion, and movably disposed between the first and second base plates for leaving or approaching the axle portion.

By the above-described technical features, the drive unit provided in the resistive force mechanism of the present invention will output a fixed torque. The torque is the result of multiplying a moment arm and a resistive force. Besides, the sliders collectively form a cylinder for the pulling cord to be wound therearound. By the sliders being driven to leave or approach the axle portion of the reel, the diameter of the cylinder can be increased or decreased, which means the moment arm corresponding to the torque is increased or decreased, so that the resistive force mechanism of the present invention can provide resistive force of different magnitude according to moment arm of different magnitude, resulting in enlarged resistive force adjustment range.

It is another objective of the present invention to provide a resistive force mechanism which has a special mechanism arrangement enabling convenient adjustment for the resistive force.

To attain the above objective, the resistive force mechanism provided by the present invention further includes an adjusting unit. The adjusting unit has an operation member and a moved member. The operation member is rotatably disposed on the reel. The moved member is driven by the operation member to drive the sliders to leave or approach the axle portion. As a result, by the operation member being rotated in a manual or electric manner, the diameter of the cylinder can be changed to provide different resistive force.

Preferably, each of the first and second base plates has a plurality of guiding grooves. The guiding grooves are arranged annularly with respect to the axle portion, and extend along radial directions of the axle portion. Each of the sliders has two guiding pillars. The guiding pillars of the sliders are movably inserted in the guiding grooves of the first and second base plates respectively. When the sliders are driven by the moved member, the guiding pillars of the sliders slide along the guiding grooves of the first and second base plates to make the sliders leave or approach the axle portion.

Preferably, the moved member is disposed on the operation member, and driven by the operation member to displace between the first and second base plates. The adjusting unit further includes a plurality of linkages. An end of each of the linkages is pivotably connected with the moved member. Another end of each of the linkages is pivotably connected with each of the sliders. The moved member is driven by the operation member to drive the linkages to swing in a way that the linkages drive the sliders to leave or approach the axle portion.

Preferably, the operation member has a threaded rod. The threaded rod is rotatably disposed on the axle portion of the reel. The moved member has a central threaded hole. The threaded rod of the operation member is screwed into the central threaded hole of the moved member. In this way, the moved member is driven by the operation member to linearly displace along the threaded rod of the operation member back and forth stably.

Preferably, the resistive force mechanism of the present invention further includes a motor seat disposed on the periphery of the reel. The adjusting unit further includes a positioning member fixed to the motor seat, and a connecting member accommodated in the positioning member. The connecting member has a through hole for the threaded rod of the operation member to be inserted through the through hole. In this way, the arrangement of the positioning member and the connecting member makes the threaded rod of the operation member rotate relative to the axle portion of the reel relatively more stably.

Preferably, the connecting member further has two sliding grooves. The adjusting unit further includes two sliding pillars. An end of each of the sliding pillars is fixed to the moved member, and another end of each of the sliding pillars is movably disposed in each of the sliding grooves of the connecting member. When the sliding pillars are driven by the moved member, the sliding pillars slide in the sliding grooves relative to the connecting member. In this way, the sliding pillars are configured to ensure the moved member to linearly slide along the threaded rod stably without swaying relative to the threaded rod.

Preferably, the moved member is disposed on the operation member, and the moved member is driven by the operation member to displace between the first and second base plates. When the moved member is displaced from the first base plate toward the second base plate, the moved member pushes the sliders to make the sliders leave the axle portion. When the moved member is displaced from the second base plate toward the first base plate, the sliders are pushed by an external force to approach the axle portion and abutted against the moved member.

Preferably, the moved member has a relatively larger radius portion, a relatively smaller radius portion opposite to the relatively larger radius portion, and a taper surface gradually narrowing from the relatively larger radius portion toward the relatively smaller radius portion. Each of the sliders has an incline. The taper surface of the moved member is configured to push the inclines of the sliders to make the sliders leave the axle portion. In this way, the sliders can move relative to the moved member relatively more smoothly.

Preferably, the moved member is disposed on the operation member, and driven by the operation member to rotate. The moved member has a plurality of arc guiding grooves. One of the guiding pillars of the sliders are inserted in the arc guiding grooves of the moved member. When the operation member drives the moved member to rotate, the aforementioned guiding pillar of the sliders are guided by the arc guiding grooves of the moved member to make the sliders leave or approach the axle portion.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The resistive force mechanism provided by the present invention will be further described in the embodiments given herein below and the accompanying drawings, and wherein.

DETAILED DESCRIPTION OF THE INVENTION

First of all, it is to be mentioned that the technical features provided by the present invention are unlimited to the specific structure, usage and application thereof described in the detailed description of the invention. It should be understood by those skilled in the related art that all the terms used in the contents of the specification are for illustrative description. The directional terms mentioned in the contents of the specification, such as 'front', 'upper', 'lower', 'rear', 'left', 'right', 'top', 'bottom', 'inside', and 'outside', are also just for illustrative description on the basis of normal usage direction, not intended to limit the claimed scope.

Figure 1:
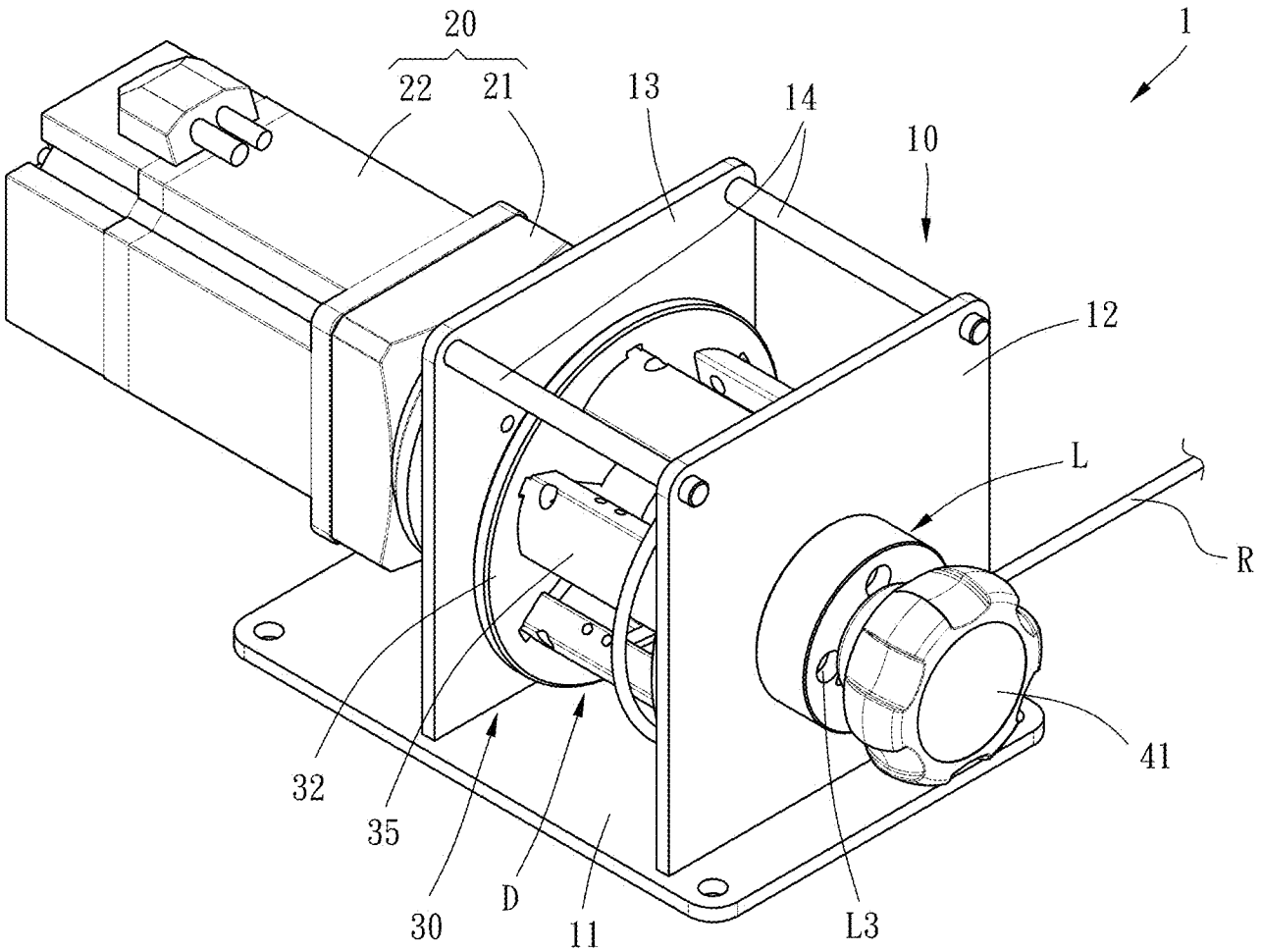
FIG. 1 is an assembled perspective view of a resistive force mechanism provided by a first embodiment of the present invention.
Figure 2:
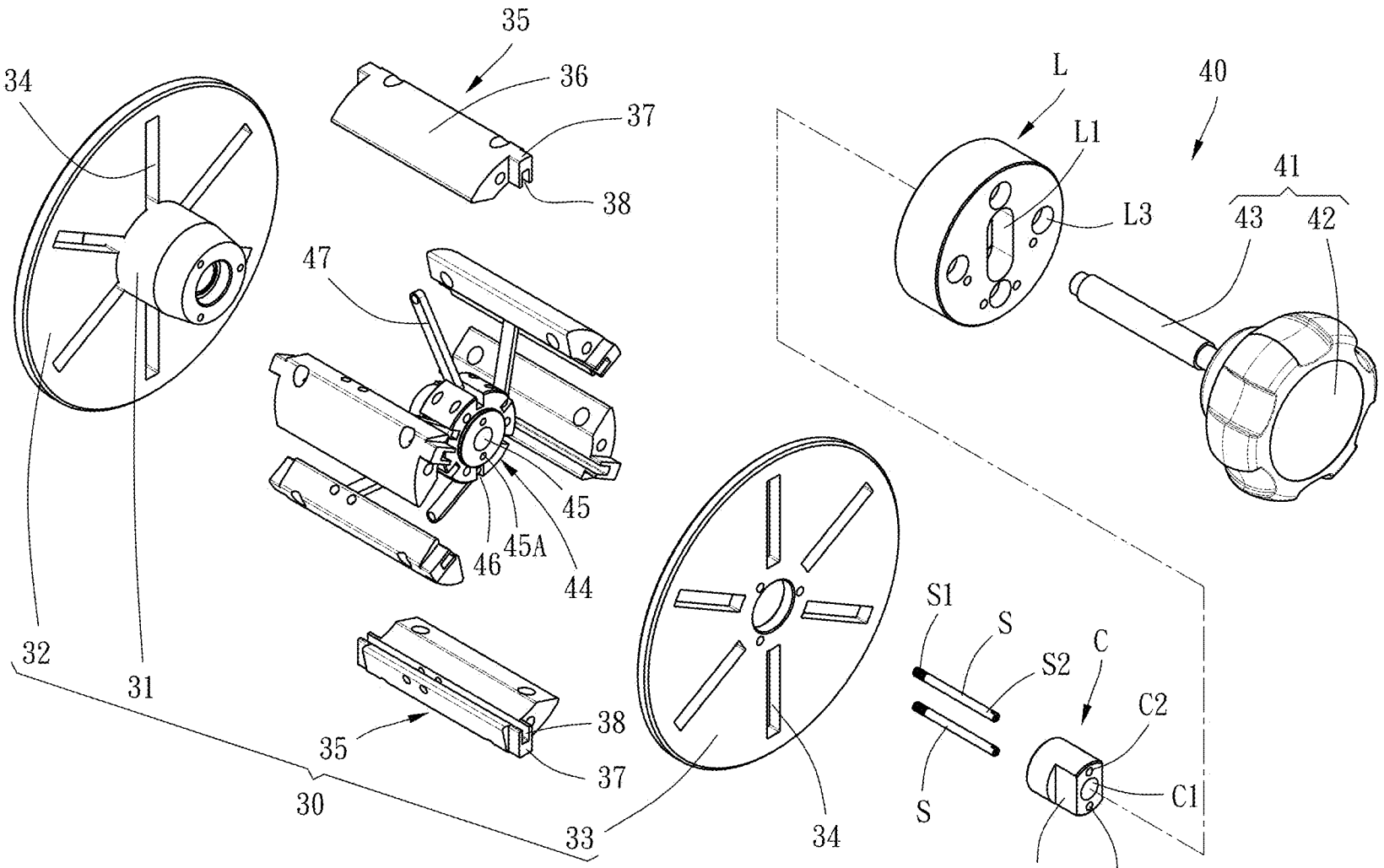
FIG. 2 is an exploded perspective view of a reel and an adjusting unit of the resistive force mechanism provided by the first embodiment of the present invention.
Figure 4:
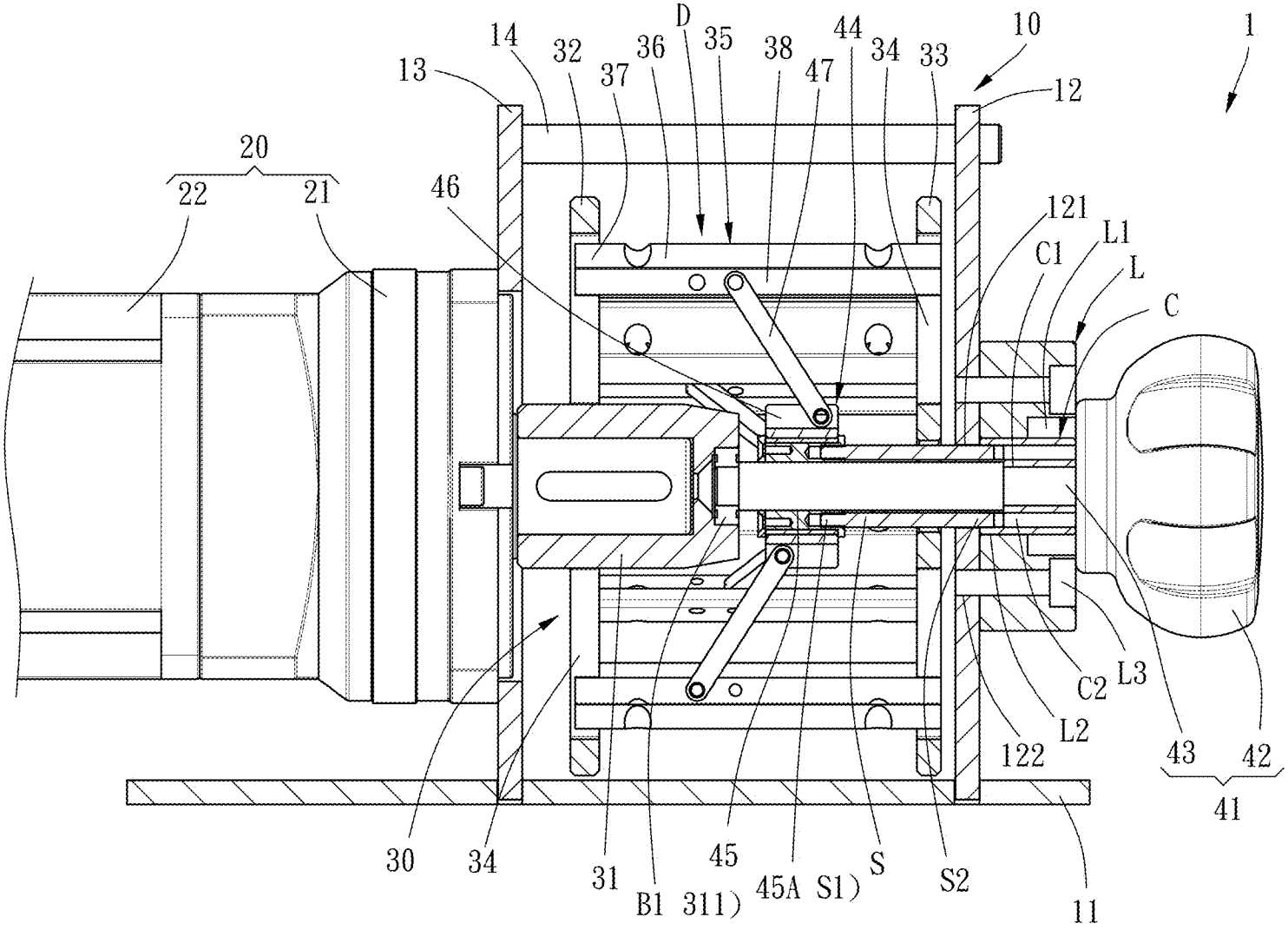
FIG. 4 is an axially sectional view of the resistive force mechanism provided by the first embodiment of the present invention, showing the sliders leave the axle portion.

Referring to FIG. 1, FIG. 2 and FIG. 4, a resistive force mechanism 1 provided by a first embodiment of the present invention includes a motor seat 10, a drive unit 20, a reel 30, and an adjusting unit 40.

As shown in FIG. 1 and FIG. 4, the motor seat 10 has a bottom plate 11, a front vertical plate 12, a rear vertical plate 13, and two supporting columns 14 disposed separately. The front vertical plate 12 has a central hole 121, and a plurality of threaded holes 122 disposed around the central hole 121. In this embodiment, there are four threaded holes 122, but unlimited to four threaded holes 122. The bottom side of the front vertical plate 12 and the bottom side of the rear vertical plate 13 are both connected to the top surface of the bottom plate 11. Two ends of each supporting column 14 are connected to the front vertical plate 12 and the rear vertical plate 13 respectively for strengthening the structure of the motor seat 10.

As shown in FIG. 1, the drive unit 20 has a decelerator 21 and a motor 22. The decelerator 21 is located above the bottom plate 11, and installed on the rear side surface of the rear vertical plate 13. The motor 22 is coaxially connected to the decelerator 21, and outputs a fixed torque through the decelerator 21.

Figure 5:
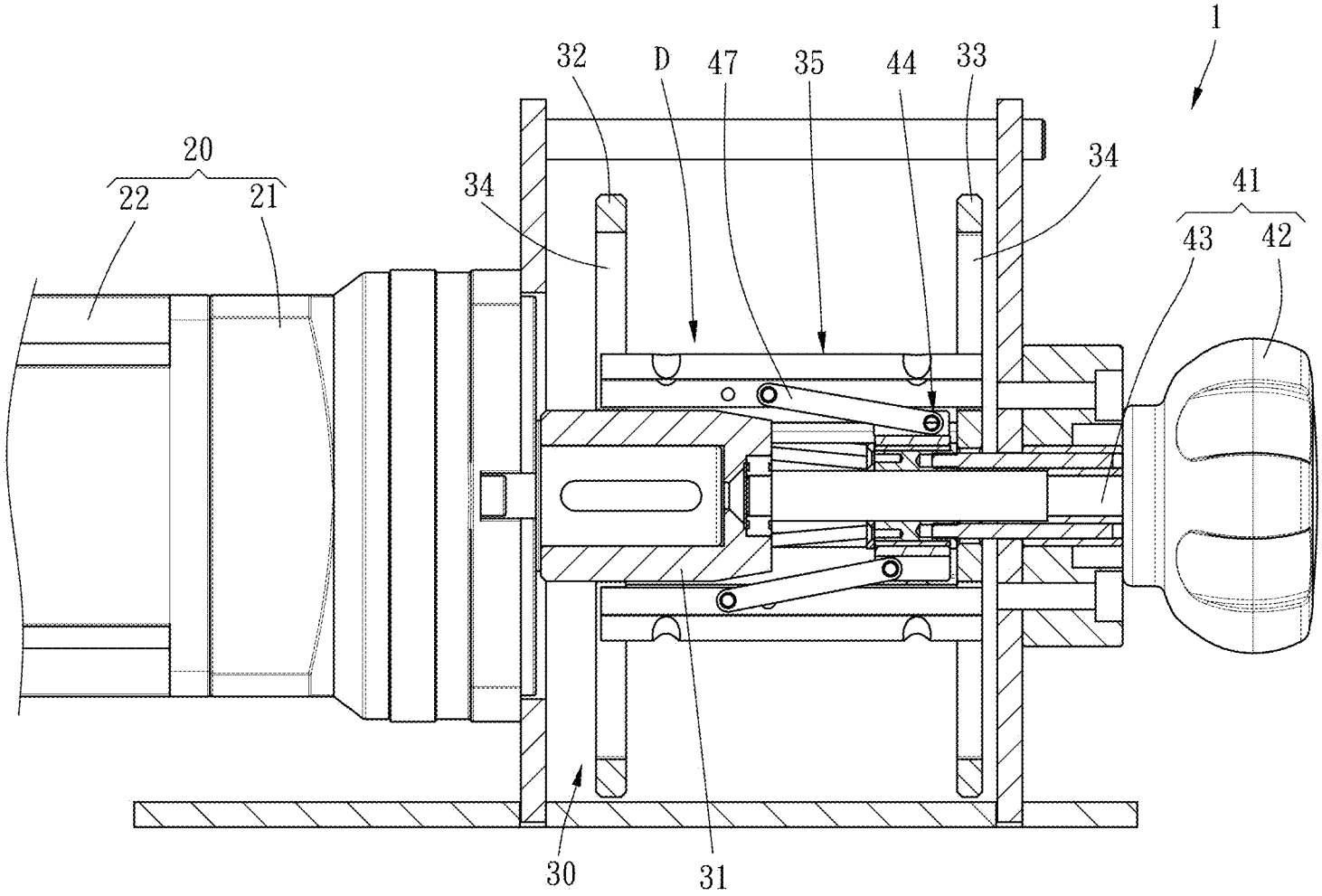
FIG. 5 follows FIG. 4, showing the sliders approach the axle portion.

As shown in FIG. 2 and FIG. 4, the reel 30 has an axle portion 31, a first base plate 32 disposed on the axle portion 31 therearound, and a second base plate 33 disposed opposite to the first base plate 32. The first and second base plates 32 and 33 each have a plurality of guiding grooves 34. They each have six guiding grooves 34 in this embodiment, but unlimited thereto. The guiding grooves 34 of the first and second base plates 32 and 33 are arranged annularly with respect to the axle portion 31, and extend along radial directions of the axle portion 31. Besides, the reel 30 further has a plurality of sliders 35. In this embodiment, there are six sliders 35, but unlimited to six sliders 35. Each slider 35 has a main body 36, and two guiding pillars 37 extending out from two ends of the main body 36 respectively. Each slider 35 is provided on the inner side surface thereof with a first groove 38. The first groove 38 extends along a direction parallel to the axle portion 31, and penetrates through the main body 36 and the two guiding pillars 37. During assembly, the axle portion 31 is coaxially connected to the decelerator 21 in a way that the first base plate 32 is disposed adjacent to the front side surface of the rear vertical plate 13 and the second base plate 33 is disposed adjacent to the rear side surface of the front vertical plate 12. Besides, the two guiding pillars 37 of each of the sliders 35 are movably inserted in the guiding grooves 34 of the first and second base plates 32 and 33 respectively, so that the sliders 35 are arranged around the axle portion 31 to collectively form a cylinder D as shown in FIG. 1. The diameter of the cylinder D can be increased by the sliders 35 being moved along the guiding grooves 34 to leave the axle portion 31, as shown in FIG. 4. Alternatively, the diameter of the cylinder D can be decreased by the sliders 35 being moved along the guiding grooves 34 to approach the axle portion 31, as shown in FIG. 5.

As shown in FIG. 1, the reel 30 is arranged for a pulling cord R to be wound therearound. An end of the pulling cord R is arranged for a user to hold, so that the pulling cord R can be pulled by the reel 30 to be wound around the cylinder D, and can be pulled by the user to be released from the reel 30 and drive the reel 30 to rotate in the released process.

Figure 3:
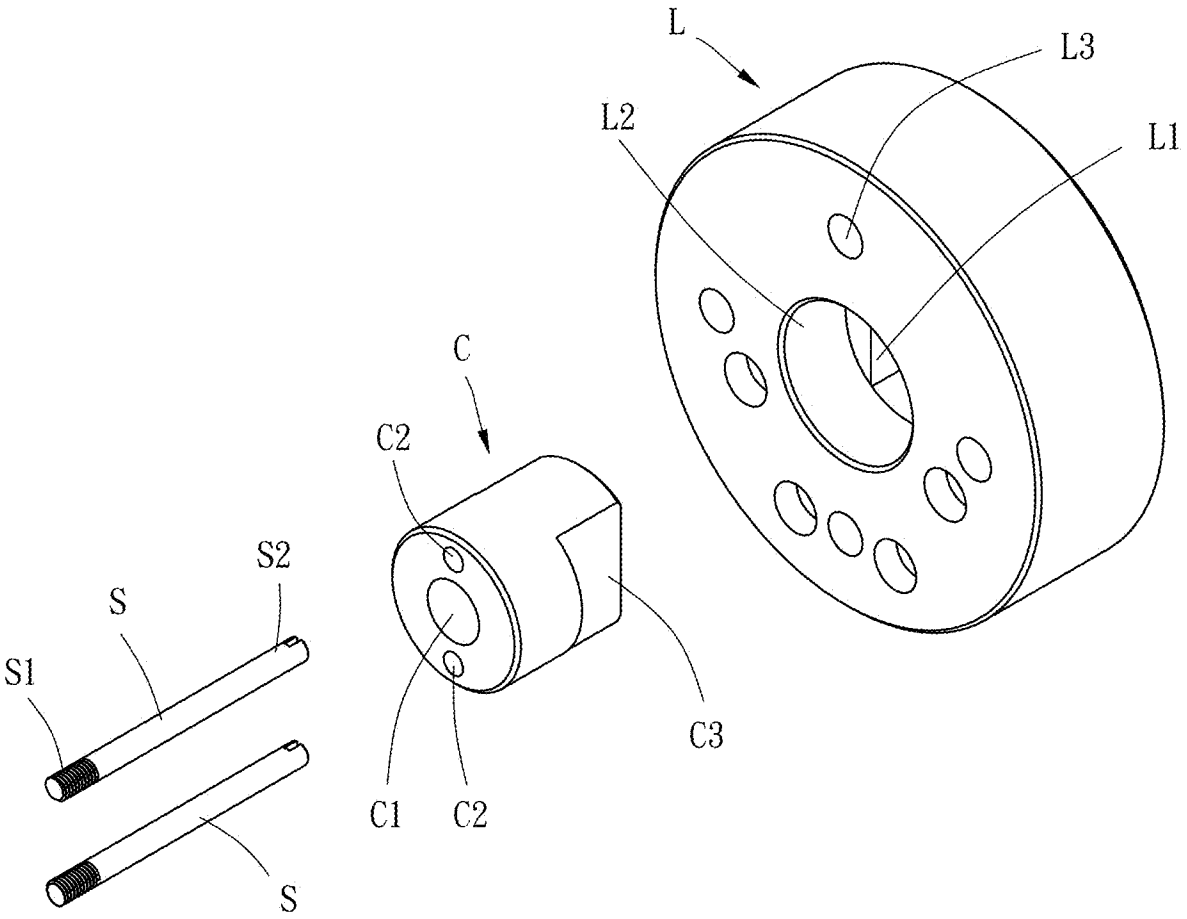
FIG. 3 is a perspective view of a positioning member and a connecting member of the resistive force mechanism provided by the first embodiment of the present invention.

As shown in FIG. 2 and FIG. 3, the adjusting unit 40 includes a positioning member L, a connecting member C, an operation member 41, a moved member 44, two sliding pillars S, and a plurality of linkages 47. In this embodiment, there are six linkages 47, but unlimited to six linkages 47.

As shown in FIG. 1 to FIG. 4, the positioning member L has an elongated hole L1 extending axially, a circular hole L2 extending axially and communicating with the elongated hole L1, and four threaded holes L3. The threaded holes L3 are arranged around the elongated hole L1, and axially penetrate through the positioning member L. During assembly, four screws (not shown) are screwed into the threaded holes L3 of the positioning member L and the threaded holes 122 of the front vertical plate 12 to fasten the positioning member L to the front side surface of the front vertical plate 12.

The connecting member C has a through hole C1 penetrating therethrough axially, and two sliding grooves C2 provided on upper and lower sides of the through hole C1 respectively and penetrating therethrough axially. Besides, the left and right sides of the connecting member C are each provided with a cut plane C3. During assembly, the connecting member C is accommodated in the elongated hole L1 and the circular hole L2 of the positioning member L, and the two cut planes C3 are abutted against the inner wall surface of the elongated hole L1.

As shown in FIG. 1, FIG. 2 and FIG. 4, the operation member 41 has a knob 42, and a threaded rod 43 connected with the knob 42. The knob 42 is abutted against the positioning member L. The threaded rod 43 is inserted through the through hole C1 of the connecting member C and the central hole 121 of the front vertical plate 12, and rotatably attached to a bearing B1. Because the bearing B1 is disposed in a bearing hole 311 of the axle portion 31, when the knob 42 drives the threaded rod 43 to rotate, the bearing B1 enables the operation member 41 to rotate relative to the axle portion 31 without moving.

As shown in FIG. 2 and FIG. 4, the moved member 44 has a central threaded hole 45 penetrating therethrough axially, and two fastening threaded holes 45A provided on upper and lower sides of the central threaded hole 45 respectively. Besides, the moved member 44 is provided on the outer periphery surface thereof with a plurality of second grooves 46. In this embodiment, there are six second grooves 46, but unlimited to six second grooves 46 in practice. The second grooves 46 are arranged annularly with respect to the central threaded hole 45. During assembly, the threaded rod 43 of the operation member 41 is screwed into the central threaded hole 45 of the moved member 44, enabling the moved member 44 to be driven by the threaded rod 43 of the operation member 41 to stably displace back and forth along the threaded rod 43. In other words, the moved member 44 is linearly displaceable back and forth between the first and second base plates 32 and 33.

As shown in FIG. 2 and FIG. 4, the two sliding pillars S each have a threaded end S1 and an inserted end S2 opposite to each other. The threaded ends S1 of the two sliding pillars S are screwed into the two fastening threaded holes 45A of the moved member 44, and the inserted ends S2 are movably disposed in the two sliding grooves C2 of the connecting member C. As shown in FIG. 4 and FIG. 5, when the moved member 44 is linearly displaced along the threaded rod 43 of the operation member 41, the two sliding pillars S are driven by the moved member 44 to slide in the two sliding grooves C2 relative to the connecting member C. In this way, the two sliding pillars S can ensure the moved member 44 to be linearly displaced along the threaded rod 43 of the operation member 41 stably without swaying relative to the threaded rod 43.

An end of the linkages 47 are inserted in the second grooves 46 of the moved member 44 and pivotably connected with the moved member 44, and another end of the linkages 47 are inserted in the first grooves 38 of the sliders 35 and pivotably connected with the sliders 35. As a result, the linkages 47 can be driven by the moved member 44 to drive the sliders 35 to slide along the guiding grooves 34 of the first and second base plates 32 and 33, thereby making the sliders 35 leave or approach the axle portion 31.

It should be complementarily mentioned here that the positioning member L and the connecting member C are configured to make the threaded rod 43 of the operation member 41 rotate relative to the axle portion 31 of the reel 30 relatively more stably. However, there can be no such positioning member L and connecting member C in this embodiment, and the threaded rod 43 of the operation member 41 is still rotatable relative to the axle portion 31 of the reel 30.

Besides, the two sliding pillars S are configured to ensure the moved member 44 to linearly slide along the threaded rod 43 stably without swaying relative to the threaded rod 43. Therefore, there can be no such sliding pillars S in other embodiments, and the moved member 44 is still linearly displaceable along the threaded rod 43 back and forth.

Following the above description, if the user wants to decrease the diameter of the cylinder D, the user has to rotate the knob 42 of the operation member 41 as shown in FIG. 4 manually to make the knob 42 drive the threaded rod 43 to drive the moved member 44 to displace along the threaded rod 43 to the position as shown in FIG. 5. Meanwhile, the moved member 44 drives the linkages 47 to swing, making the linkages 47 drive the sliders 35 to slide along the guiding grooves 34 of the first and second base plates 32 and 33 to approach the axle portion 31, so that the diameter of the cylinder D is decreased, which means the moment arm is decreased. As a result, in the condition that the torque outputted by the drive unit 20 is fixed, because the torque is the result of multiplying the moment arm and the resistive force, the decreased moment arm makes the corresponding resistive force increased, so that a relatively larger resistive force is provided for training the user who pulls the pulling cord R as shown in FIG. 1. For example, the torque outputted by the drive unit 20 is from 10 Newton-meters to 30 Newton-meters, the original diameter of the cylinder D is 10 meters, and the corresponding resistive force is from 1 Newton to 3 Newtons. When the diameter of the cylinder D is decreased to 5 meters, which means the diameter of the cylinder D is decreased to the half of the original diameter, the corresponding resistive force is from 2 Newton-meters to 6 Newton-meters.

On the contrary, if the user wants to increase the diameter of the cylinder D, the user has to reversely rotate the knob 42 of the operation member 41 as shown in FIG. 5 manually to make the knob 42 drive the threaded rod 43 to drive the moved member 44 to linearly displace along the threaded rod 43 to the position as shown in FIG. 4. Meanwhile, the moved member 44 drives the linkages 47 to swing, making the linkages 47 drive the sliders 35 to slide along the guiding grooves 34 of the first and second base plates 32 and 33 to leave the axle portion 31, so that the diameter of the cylinder D is increased, which means the moment arm is increased. As a result, in the condition that the torque outputted by the drive unit 20 is fixed, the increased moment arm makes the corresponding resistive force decreased, so that a relatively smaller resistive force is provided for training the user who pulls the pulling cord R as shown in FIG. 1. For example, the torque outputted by the drive unit 20 is from 10 Newton-meters to 30 Newton-meters, the original diameter of the cylinder D is 10 meters, and the corresponding resistive force is from 1 Newton to 3 Newtons. When the diameter of the cylinder D is increased to 20 meters, which is twice the original diameter, the corresponding resistive force is from 0.5 Newton-meters to 1.5 Newton-meters.

Figure 6:
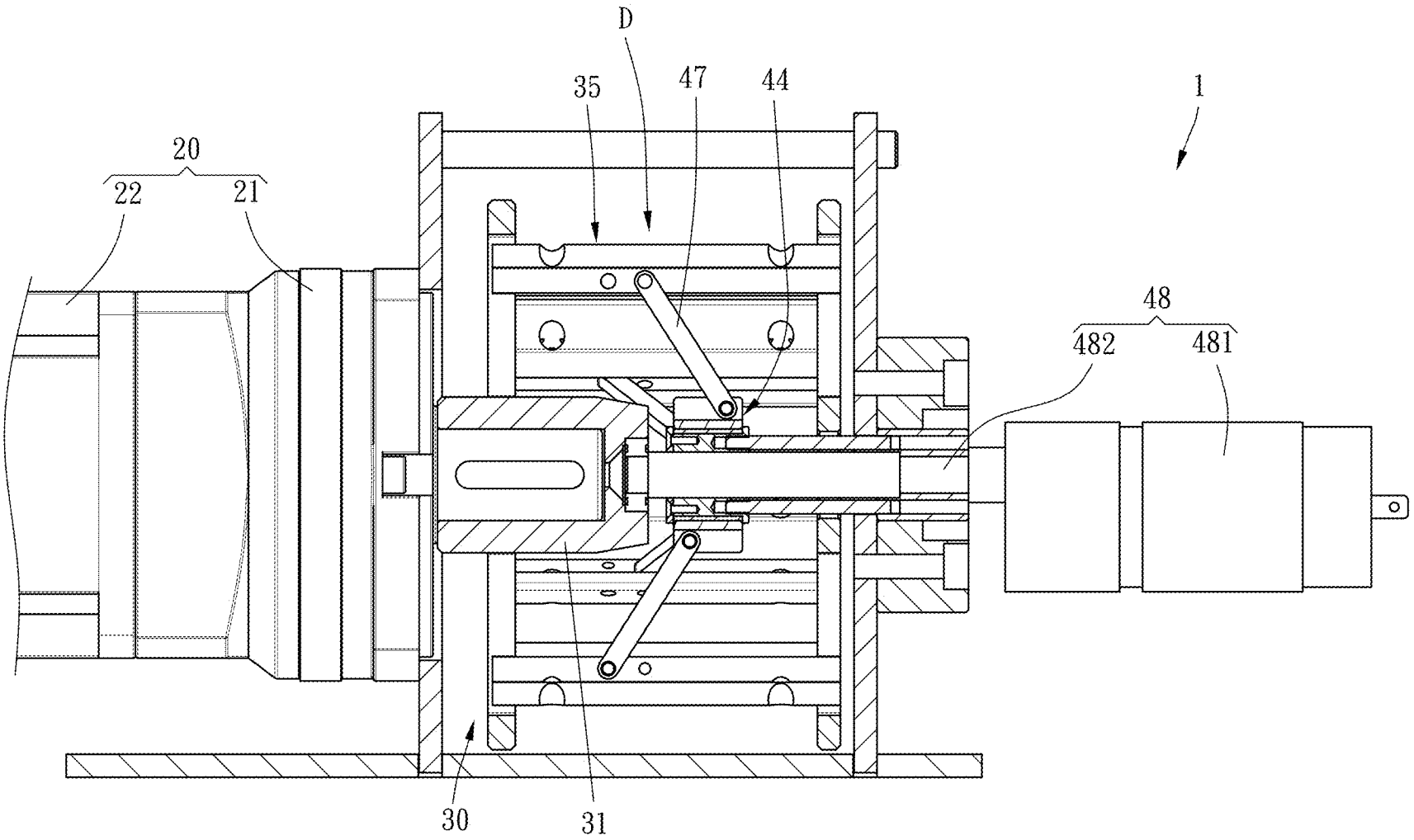
FIG. 6 is an axially sectional view of another kind of resistive force mechanism provided by the first embodiment of the present invention, and an operation member thereof is a driving motor.

Referring to FIG. 6, the operation member 41 may be replaced by an electrically driven operation member 48 for providing the user diverse choices. In this embodiment, the operation member 48 has a motor 481, and a threaded rod 482 connected with the motor 481. The user can relatively more accurately control the direction and time of the rotation of the motor 481 through an external device such as cellphone, computer and so on, or through a machine control interface, making the motor 481 drive the threaded rod 482 to drive the moved member 44 to linearly displace along the threaded rod 482, so as to make the moved member 44 drive the linkages 47 to drive the sliders 35 to leave or approach the axle portion 31, thereby increasing or decreasing the diameter of the cylinder D to provide the user the required resistive force.

Figure 7:
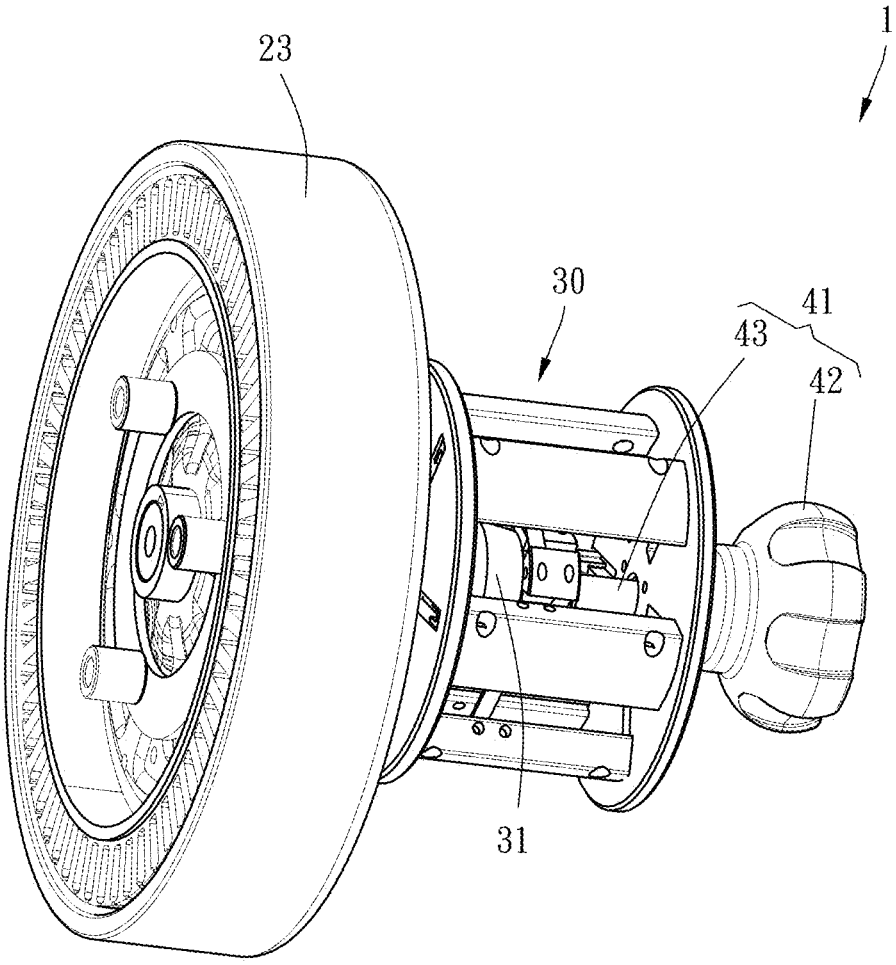
FIG. 7 is an assembled perspective view of the resistive force mechanism provided by the first embodiment of the present invention, showing a drive unit is a multipole motor.
Figure 8:
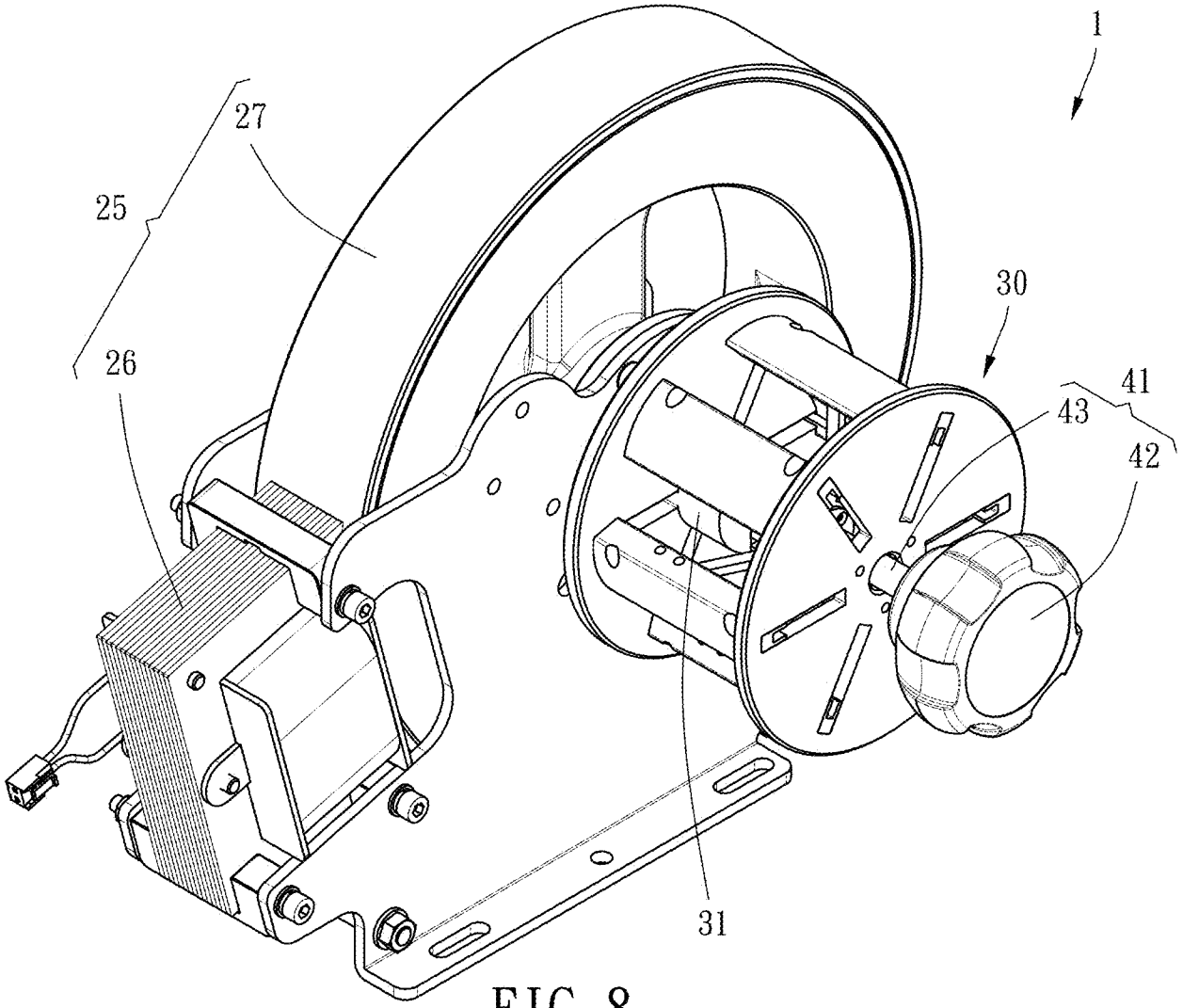
FIG. 8 is an assembled perspective view of the resistive force mechanism provided by the first embodiment of the present invention, showing the drive unit is a flywheel module.

Further speaking, the drive unit 20 of the resistive force mechanism 1 provided by the first embodiment of the present invention may be replaced by mechanisms of different types. Referring to FIG. 7, the drive unit 23 is a multipole motor. The drive unit 23 (multipole motor) is coaxially connected to the axle portion 31 of the reel 30 for driving the reel 30 to rotate. Referring to FIG. 8, the drive unit 25 is a flywheel module. The drive unit 25 (flywheel module) has an electromagnet 26, and a flywheel 27 which can be magnetically attracted to the electromagnet 26. The flywheel 27 is coaxially connected to the axle portion 31 of the reel 30. The user pushes a pedal (not shown) to drive the flywheel 27 to drive the reel 30 to rotate.

Figure 9:
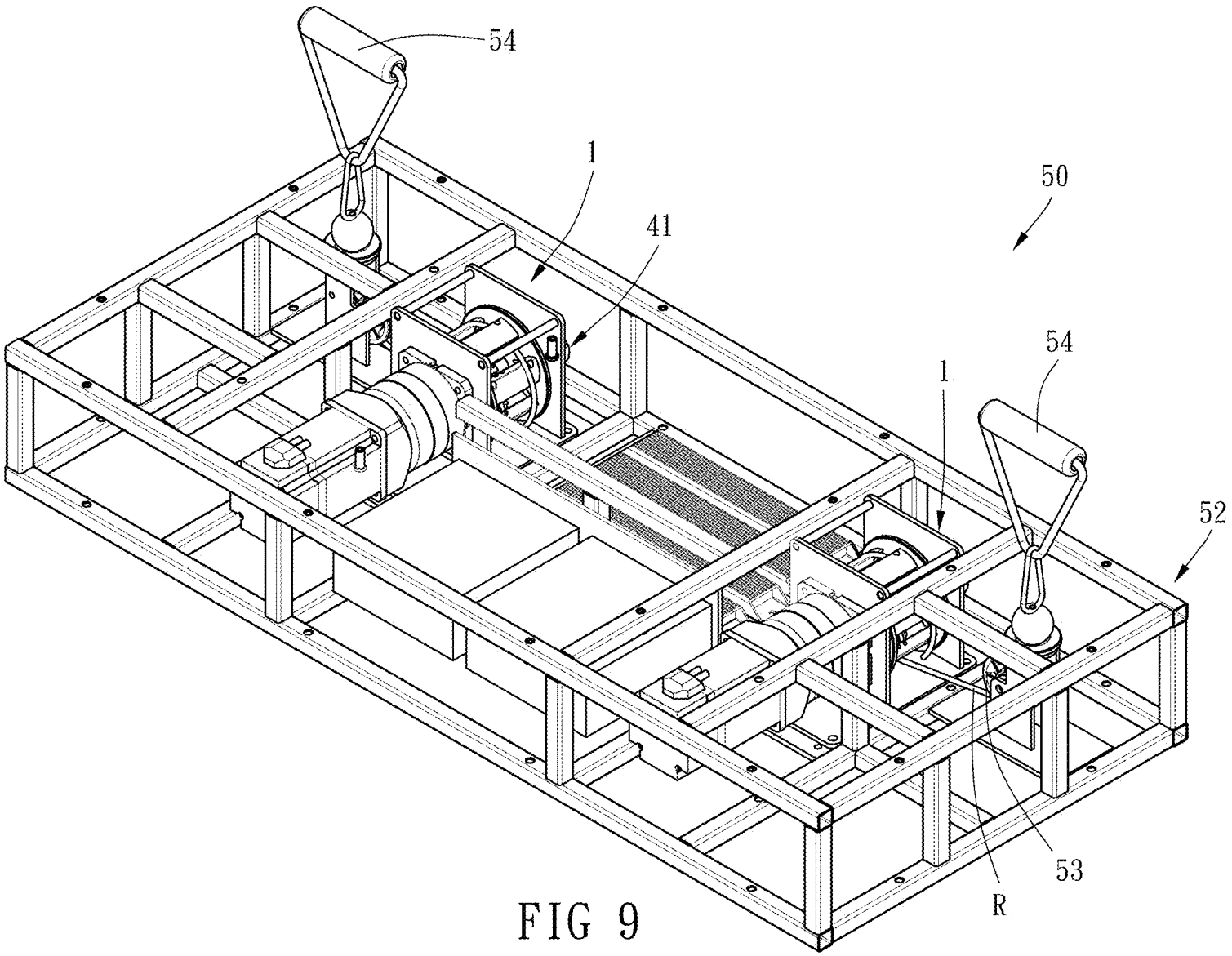
FIG. 9 is an assembled perspective view of a plank trainer applied with the resistive force mechanism provided by the first embodiment of the present invention, and a top plate of the plank trainer is omitted.
Figure 10:
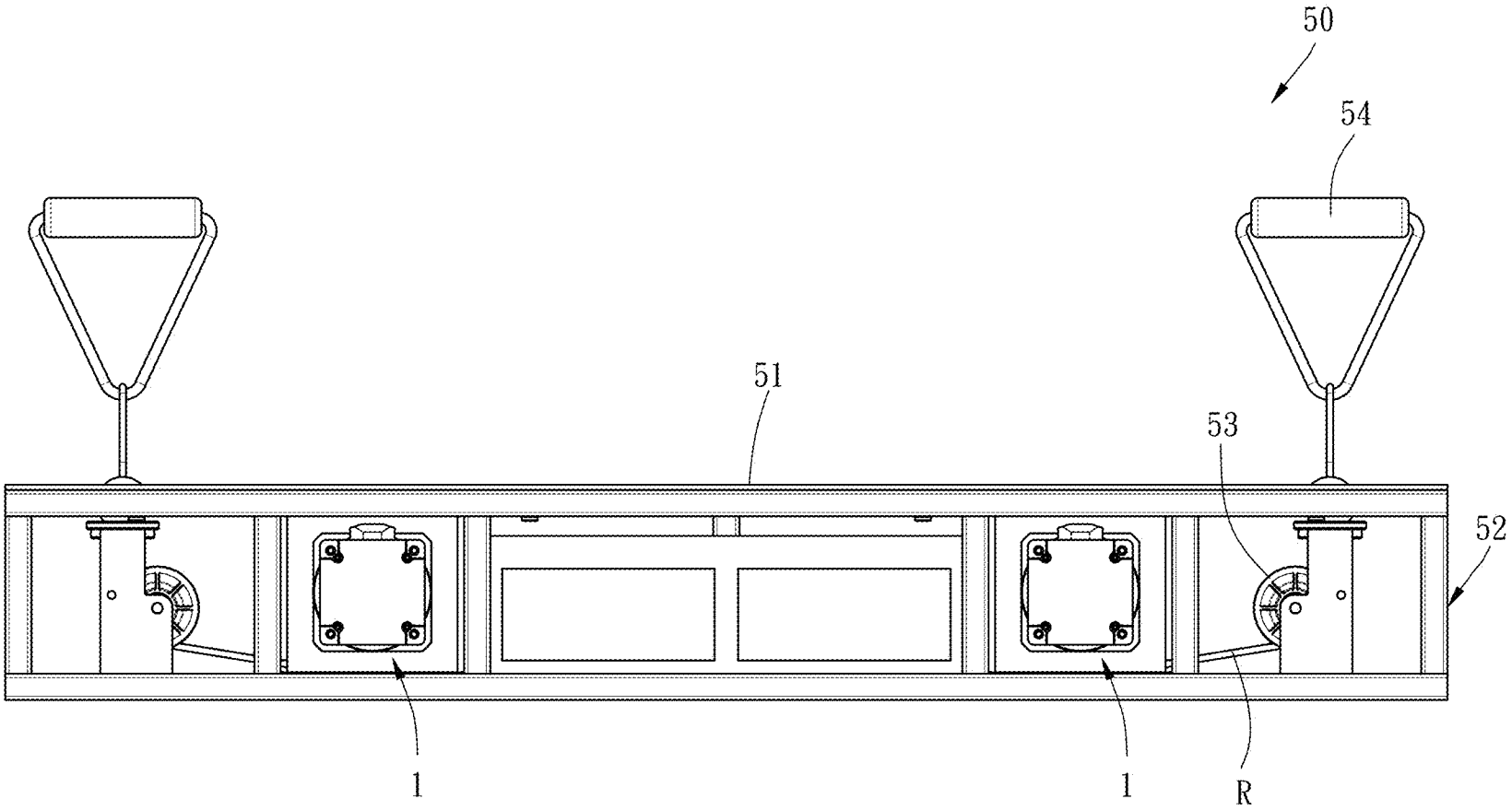
FIG. 10 is a front view of the plank trainer applied with the resistive force mechanism provided by the first embodiment of the present invention.
Figure 11:
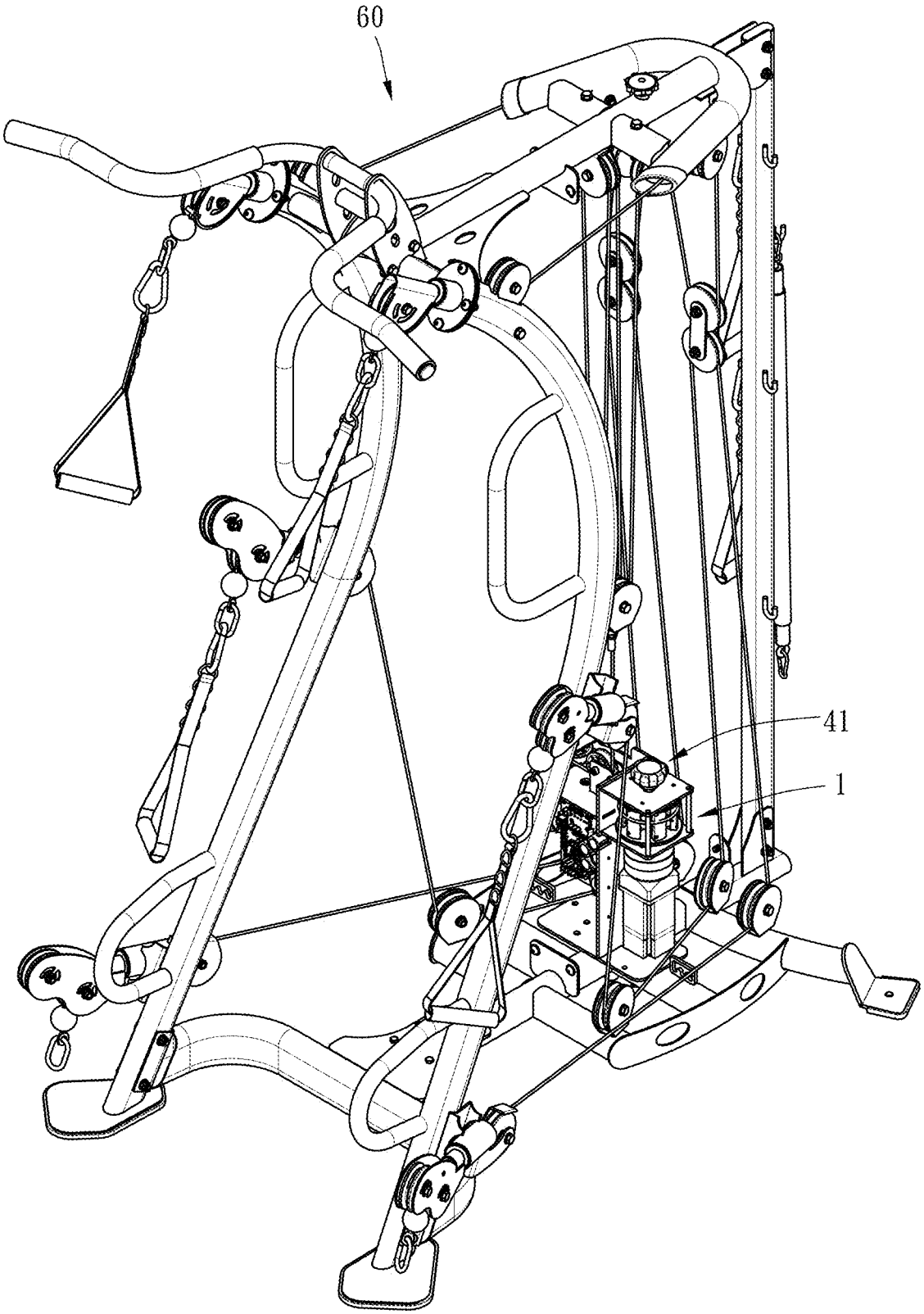
FIG. 11 is an assembled perspective view of a multi-training machine applied with the resistive force mechanism provided by the first embodiment of the present invention.

Further speaking, the resistive force mechanism 1 provided by the first embodiment of the present invention may be applied to fitness equipment of different types for providing the user diverse training modes. Referring to FIG. 9 and FIG. 10, the resistive force mechanism 1 may be applied to a plank trainer 50. The plank trainer 50 has a top plate 51, an accommodating box 52 covered by the top plate 51, two resistive force mechanisms 1 separately disposed in the accommodating box 52, two pulling cords R wound around the reels 30 of the resistive force mechanisms 1 respectively, two pulleys 53 wound by the pulling cords R respectively, and two handles 54 connected with the terminal ends of the pulling cords R respectively. In practical use, the user steps on the top plate 51 of the plank trainer 50 and uses both hands to hold the two handles 54 to pull them upwardly to make the two pulling cords R drive the two reels 30 to rotate for exercise training of different resistive force. It should be complementarily mentioned here that this embodiment is described as an example. The plank trainer 50 is unlimited to be arranged with two resistive force mechanisms 1, two pulling cords R, two pulleys 53 and two handles 54. The plank trainer 50 actually only has to include one resistive force mechanism 1, one pulling cord R, one pulley 53 and one handle 54, that can attain the training effect for the user. Referring to FIG. 11, the resistive force mechanism 1 may be applied to a multi-training machine 60 for providing the user exercise training of different resistive force.

Figure 12:
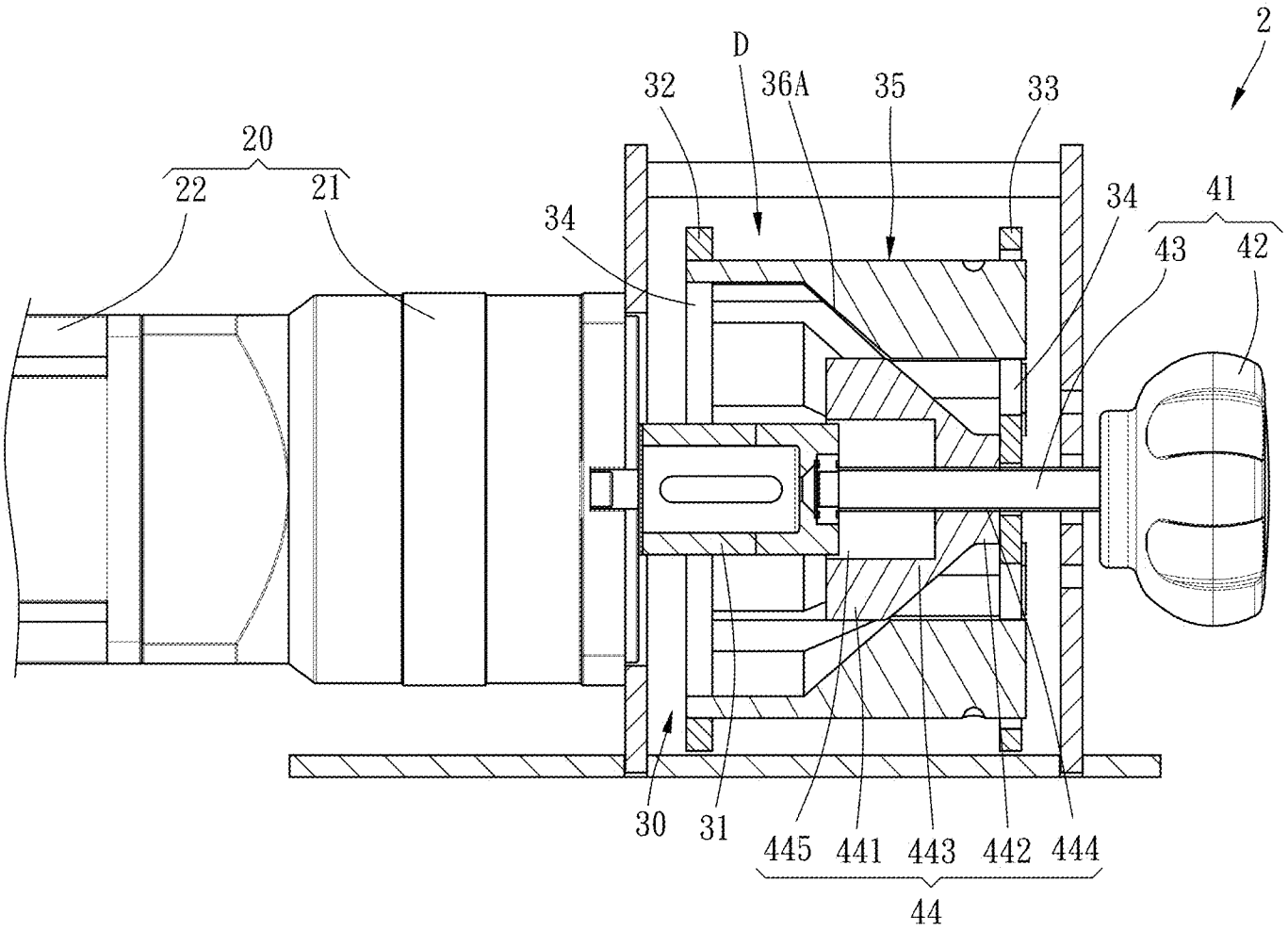
FIG. 12 is an axially sectional view of a resistive force mechanism provided by a second embodiment of the present invention, showing the sliders leave the axle portion.
Figure 13:
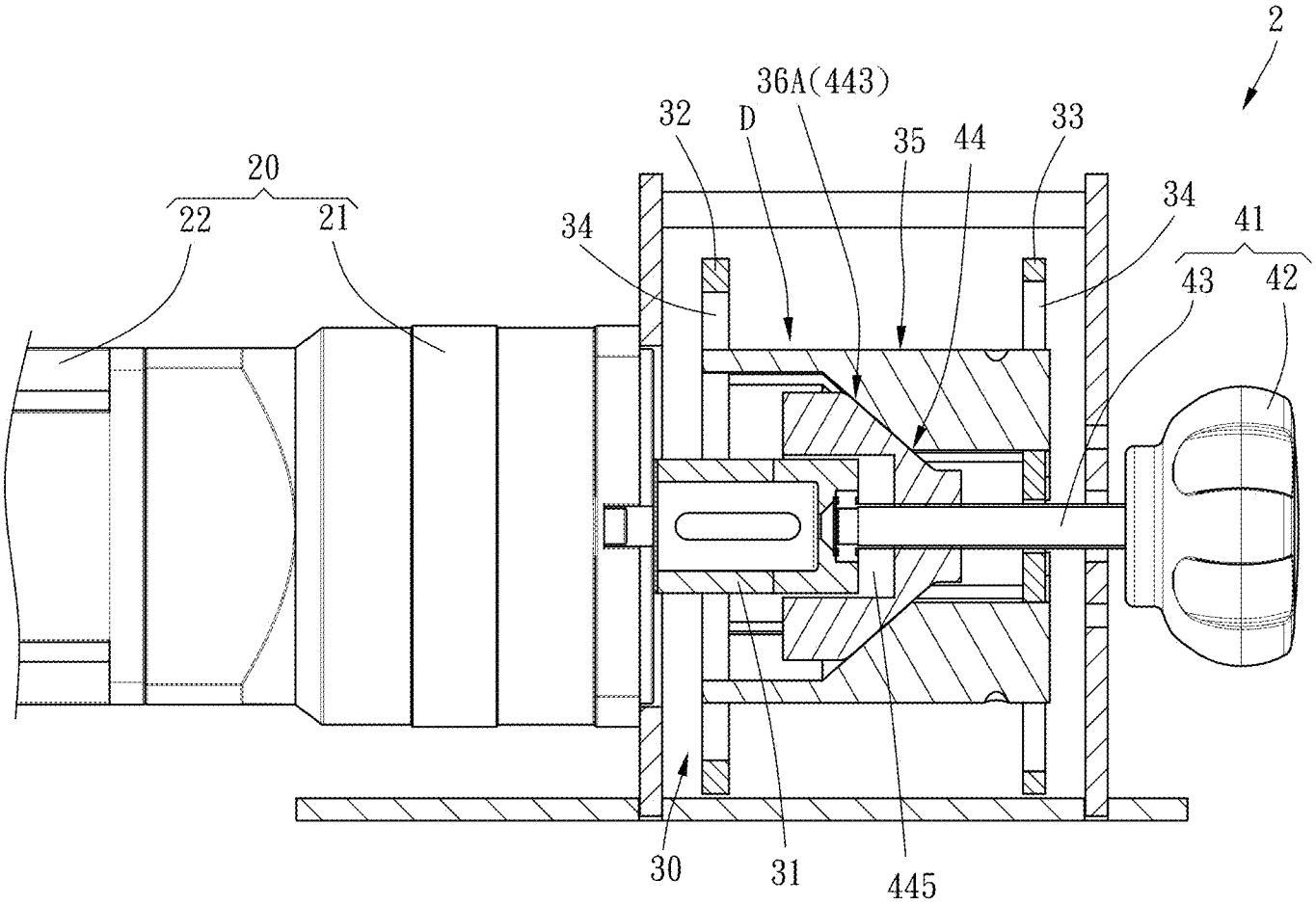
FIG. 13 follows FIG. 12, showing the sliders approach the axle portion.

However, the resistive force mechanism 1 is unlimited to that disclosed in the above embodiment. Referring to FIG. 12 and FIG. 13, a resistive force mechanism 2 provided by a second embodiment of the present invention is approximately the same in structure with the first embodiment, but the primary difference therebetween lies in the sliders 35' and the moved member 44'. In this embodiment, the inner circumferential surface of each slider 35' is an incline 36A. The moved member 44' has a relatively larger radius portion 441, a relatively smaller radius portion 442 opposite to the relatively larger radius portion 441, and a taper surface 443 gradually narrowing from the relatively larger radius portion 441 to the relatively smaller radius portion 442. Besides, the moved member 44' has a threaded hole 444 extending axially, and an accommodating hole 445 extending axially and communicating with the threaded hole 444. The threaded rod 43 of the operation member 41 is screwed into the threaded hole 444 of the moved member 44, enabling the moved member 44' to be driven by the operation member 41 to linearly displace along the threaded rod 43 back and forth. In other word, the moved member 44' is displaceable back and forth between the first and second base plates 32 and 33.

In practical operation, if the user wants to decrease the diameter of the cylinder D, the user has to rotate the knob 42 of the operation member 41 as shown in FIG. 12 manually. The knob 42 drives the threaded rod 43 to drive the moved member 44' to displace along the threaded rod 43 to the position as shown in FIG. 13. In other words, the moved member 44' is displaced from the second base plate 33 toward the first base plate 32. After that, the motor 22 is started to drive the reel 30 to rotate through the decelerator 21, making the pulling cord R as shown in FIG. 1 wound around the cylinder D. In other words, the pulling cord R is wound around the outer surface of the sliders 35'. The sliders 35' are girt up by the pulling cord R, thereby sliding inwardly along the guiding grooves 34 of the first and second base plates 32 and 33 to approach the axle portion 31, and the inclines 36A are abutted against the taper surface 443 of the moved member 44', making the diameter of the cylinder D decreased, so that the resistive force provided by the resistive force mechanism 2 of the second embodiment of the present invention is increased.

On the contrary, if the user wants to increase the diameter of the cylinder D, at this time the motor 22 stays off and doesn't need to be started, and then the user has to reversely rotate the knob 42 of the operation member 41 as shown in FIG. 13. Through the threaded rod 43, the knob 42 drives the moved member 44' to displace along the threaded rod 43 to the position as shown in FIG. 12. In other words, the moved member 44' is displaced from the first base plate 32 toward the second base plate 33. Meanwhile, the moved member 44' is sleeved onto the axle portion 31 of the reel 30 by the accommodating hole 445, and the taper surface 443 pushes the inclines 36A of the sliders 35' to make the sliders 35' slide outwardly along the guiding grooves 34 of the first and second base plates 32 and 33 to leave the axle portion 31, making the diameter of the cylinder D increased, so that the resistive force provided by the resistive force mechanism 2 of the second embodiment of the present invention is decreased.

It should be complementarily mentioned here that as shown in FIG. 12 and FIG. 13, the taper surface 443 of the moved member 44' is configured for pushing the inclines 36A of the sliders 35' to make the sliders 35' leave the axle portion 31, so the sliders 35' can be moved relative to the moved member 44' relatively more smoothly.

Figure 14:
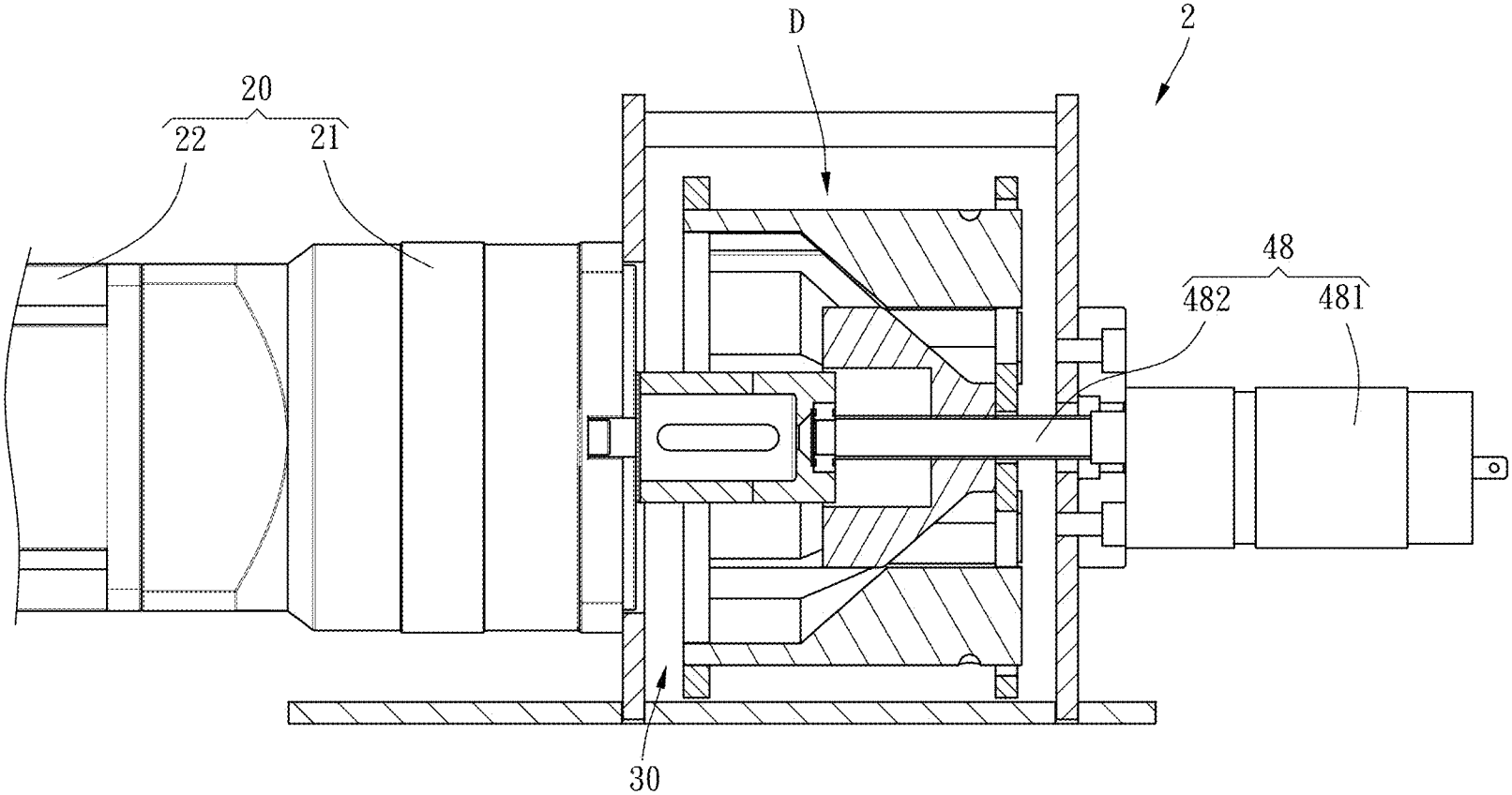
FIG. 14 is similar to FIG. 13, but the operation member thereof is a driving motor.

Besides, in this embodiment, the operation member 41 may be replaced by the operation member 48 as shown in FIG. 14, i.e. the assembly of the motor 481 and the threaded rod 482, which can control the diameter of the cylinder D relatively more accurately to provide the user the required resistive force.

Figure 15:
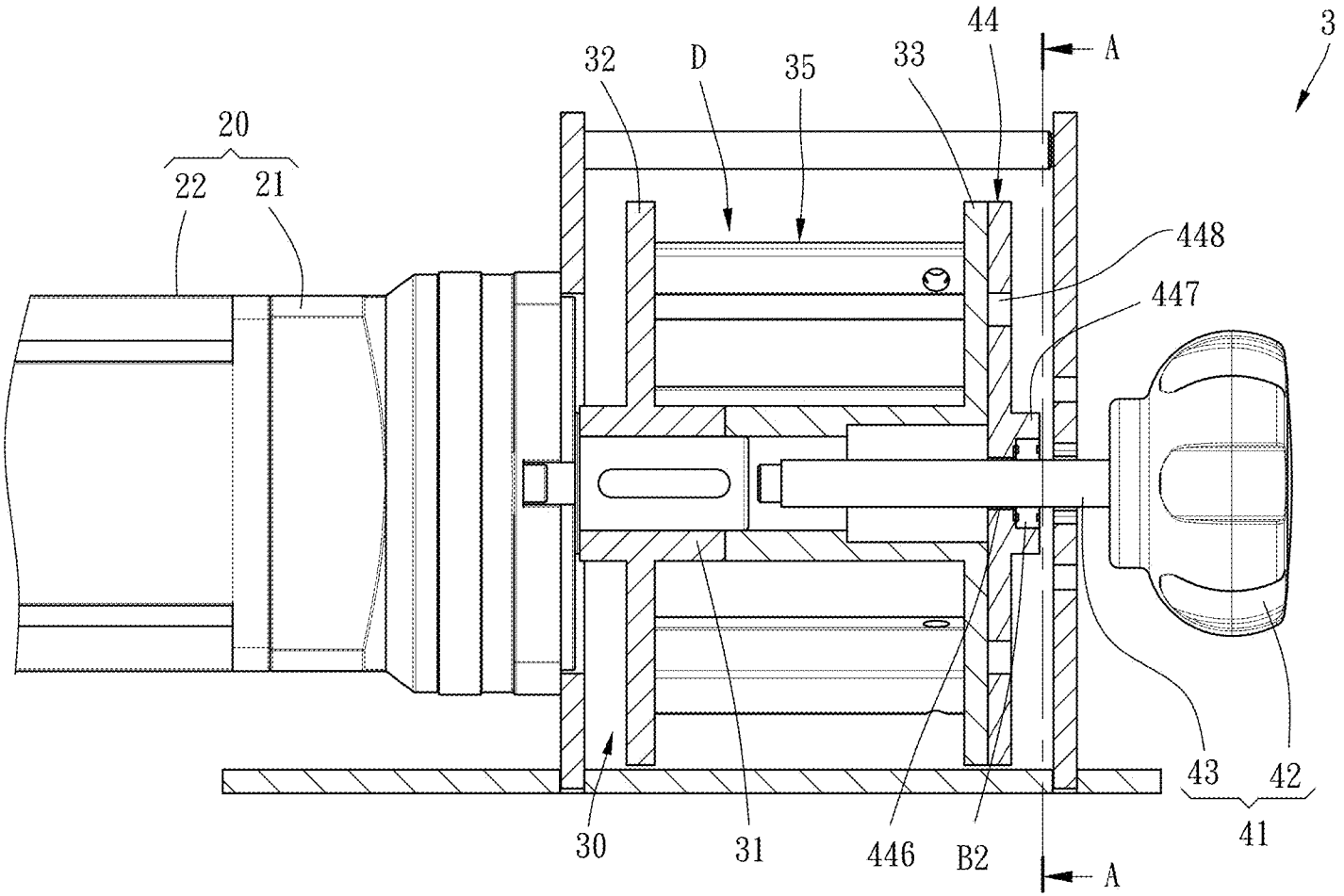
FIG. 15 is an axially sectional view of a resistive force mechanism provided by a third embodiment of the present invention, showing the sliders leave the axle portion.
Figure 16:
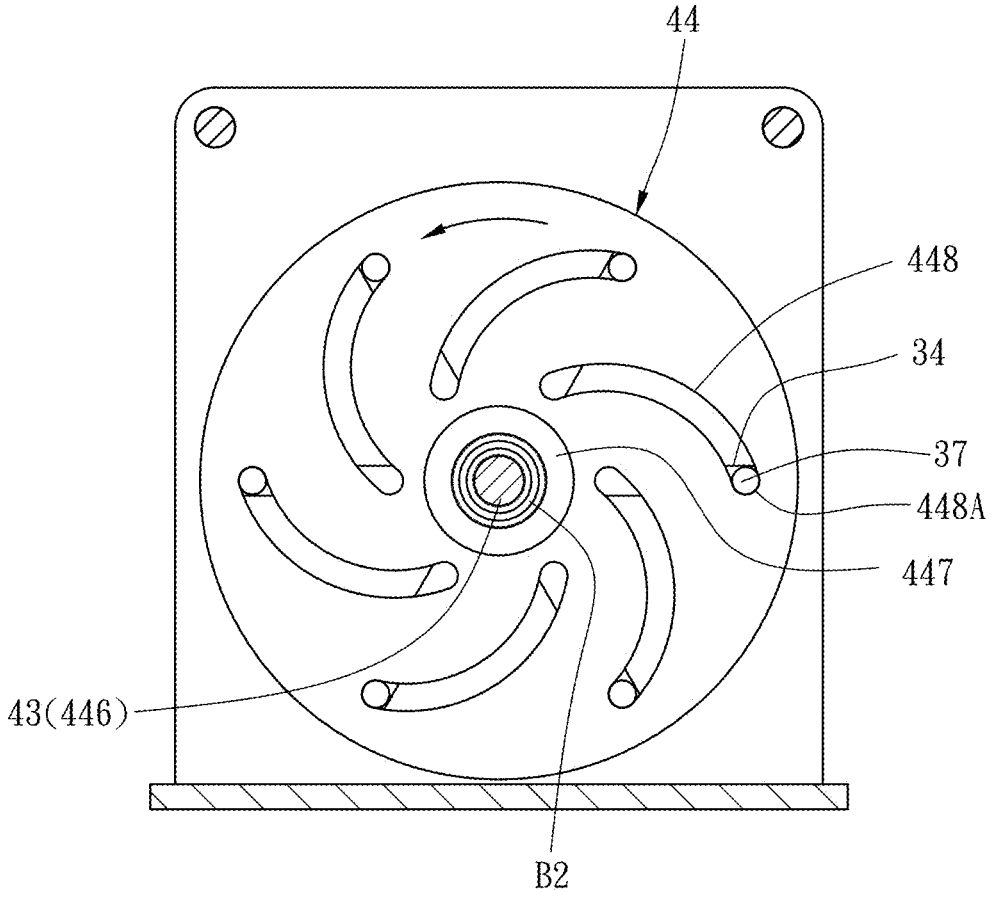
FIG. 16 is a sectional view taken along the line A-A in FIG. 15, showing two guiding pillars of the sliders are guided by arc guiding grooves of a moved member.

Referring to FIG. 15 and FIG. 16, a resistive force mechanism 3 provided by a third embodiment of the present invention is approximately the same in structure with the first embodiment, but the primary difference therebetween lies in the moved member 44". Further speaking, the moved member 44" is a plate-shaped configuration, which has a central axial hole 446, a flange 447 surrounding the central axial hole 446, and a plurality of arc guiding grooves 448. In this embodiment, there are six arc guiding grooves 448, but unlimited to six arc guiding grooves 448. The arc guiding grooves 448 are provided separately from the central axial hole 446, and each arc guiding groove 448 has a front end 448A and a rear end 448B opposite to each other.

Referring to FIG. 15 and FIG. 16, a bearing B2 is disposed in the flange 447 of the moved member 44", and the moved member 44" is sleeved onto the threaded rod 43 of the operation member 41 by the central axial hole 446, so that the threaded rod 43 and the moved member 44" are rotatably connected through the bearing B2, resulting in that when the knob 42 of the operation member 41 drives the threaded rod 43 to rotate, the bearing B2 makes the threaded rod 43 and the moved member 44" rotate together without moving. Besides, the rear side surface of the moved member 44" is abutted against the second base plate 33 in a way that one of the guiding pillars 37 of the sliders 35 are inserted in the arc guiding grooves 448 of the moved member 44". In this way, when the operation member 41 drives the moved member 44" to rotate, the guiding pillars 37 of the sliders 35 are guided by the arc guiding grooves 448 of the moved member 44', making the sliders 35 leave the axle portion 31 to make the diameter of the cylinder D increased (as shown in FIG. 15 and FIG. 16), or making the sliders 35 approach the axle portion 31 to make the diameter of the cylinder D decreased (as shown in FIGS. 17 and 18).

Figure 17:
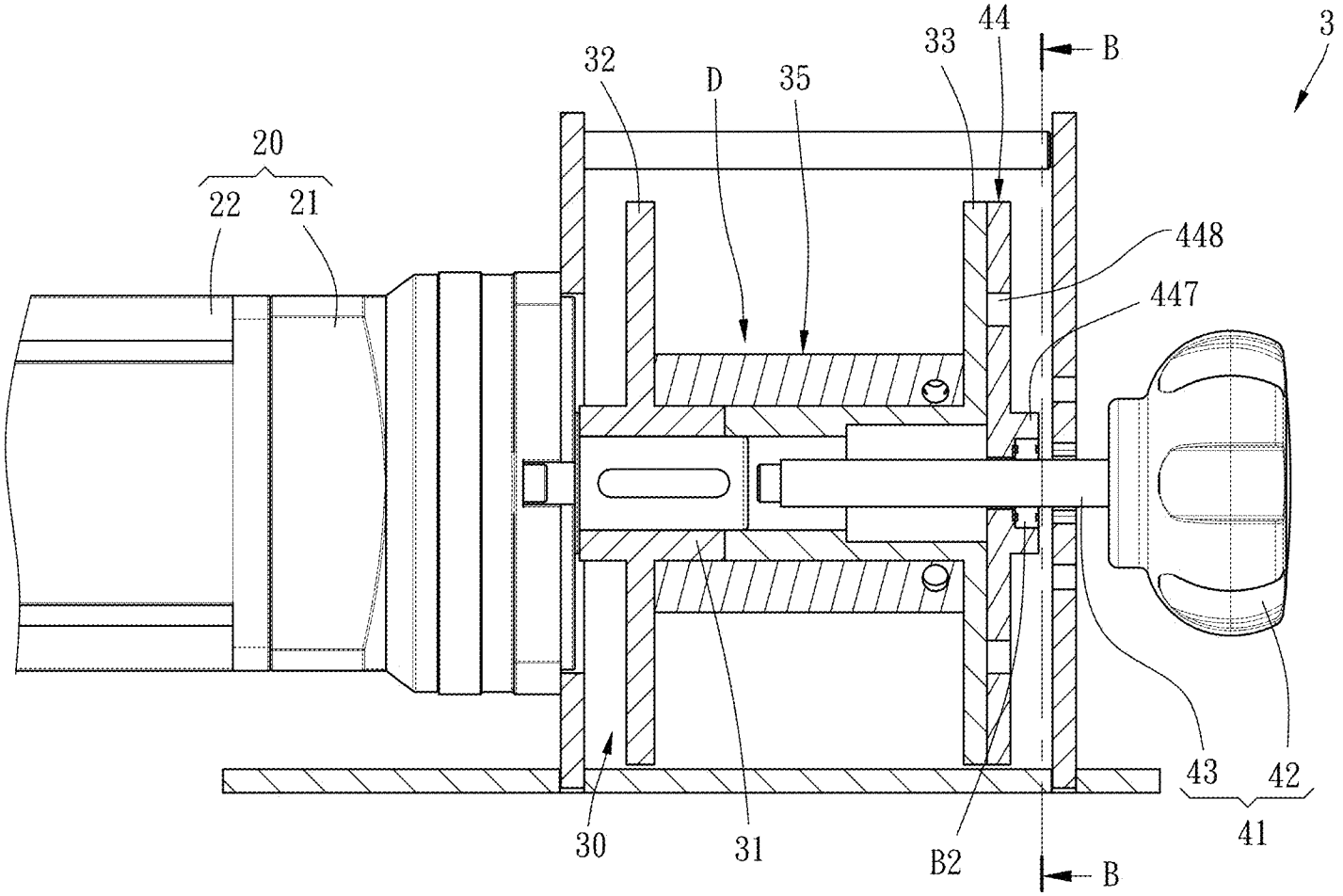
FIG. 17 follows FIG. 15, showing the sliders approach the axle portion.
Figure 18:
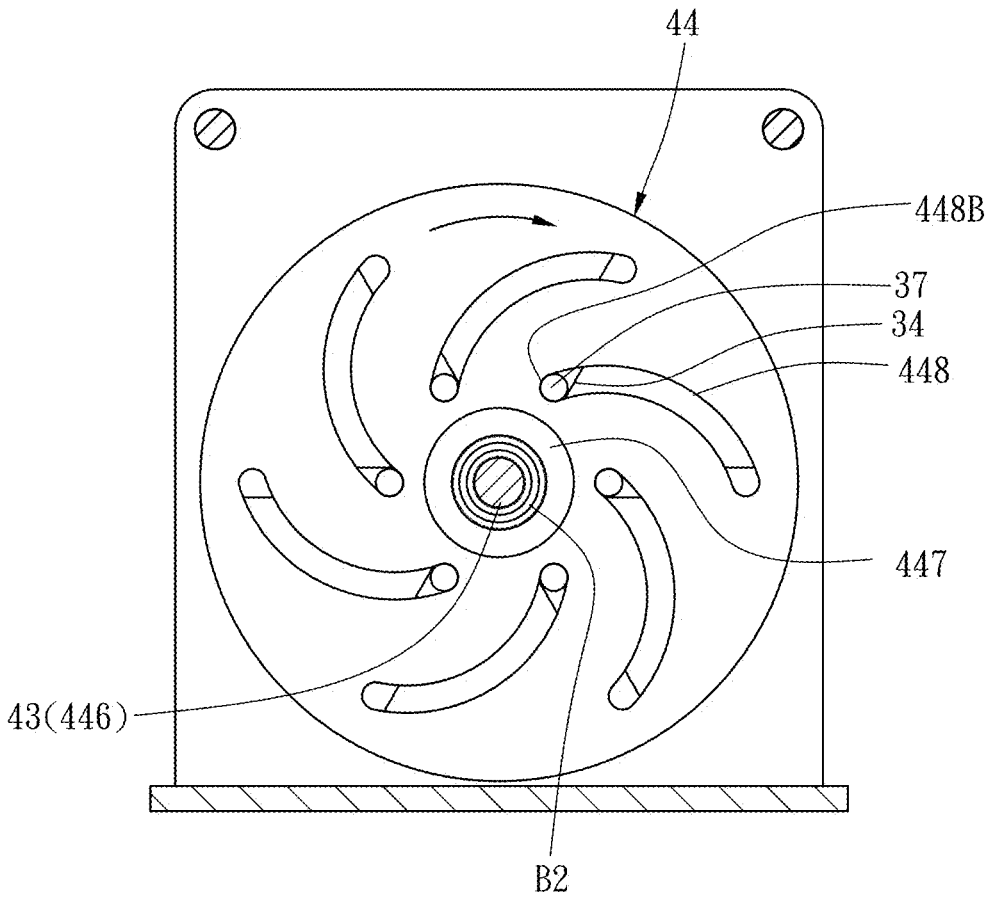
FIG. 18 is a sectional view taken along the line B-B in FIG. 17, showing two guiding pillars of the sliders are guided by the arc guiding grooves of the moved member.

It can be known from the above description that if the user wants to decrease the diameter of the reel 30, the user has to rotate the knob 42 of the operation member 41 as shown in FIG. 15 to, through the threaded rod 43, drive the moved member 44" to rotate to the position as shown in FIG. 17. Meanwhile, the guiding pillars 37 as shown in FIG. 16 are guided by the front ends 448A of the arc guiding grooves 448. The guiding pillars 37 push the second base plate 33 through the guiding grooves 34, making the second base plate 33 and the moved member 44" rotate together. Meanwhile, the sliders 35 drive the first base plate 32 to rotate, making the reel 30 rotate by taking the axle portion 31 as the center to the position as shown in FIG. 17 and FIG. 18. During the rotation of the reel 30, the sliders 35 slide gradually inwardly along the guiding grooves 34 of the first and second base plates 32 and 33 to approach the axle portion 31, making the diameter of the cylinder D decreased, so that the resistive force provided by the resistive force mechanism 3 of the third embodiment of the present invention is increased.

On the contrary, if the user wants to increase the diameter of the cylinder D, the user has to reversely rotate the knob 42 of the operation member 41 as shown in FIG. 17 to, through the threaded rod 43, drive the moved member 44" to rotate to the position as shown in FIG. 15. Meanwhile, the guiding pillars 37 as shown in FIG. 18 are guided by the rear ends 448B of the arc guiding grooves 448 to push the second base plate 33 through the guiding grooves 34, making the second base plate 33 and the moved member 44" rotate together. Meanwhile, the sliders 35 drive the first base plate 32 to rotate, making the reel 30 rotate by taking the axle portion 31 as the center to the position as shown in FIG. 15 and FIG. 16. During the rotation of the reel 30, the sliders 35 slide gradually outwardly along the guiding grooves 34 of the first and second base plates 32 and 33 to leave the axle portion 31, making the diameter of the cylinder D increased, so that the resistive force provided by the resistive force mechanism 3 of the third embodiment of the present invention is decreased.

Figure 19:
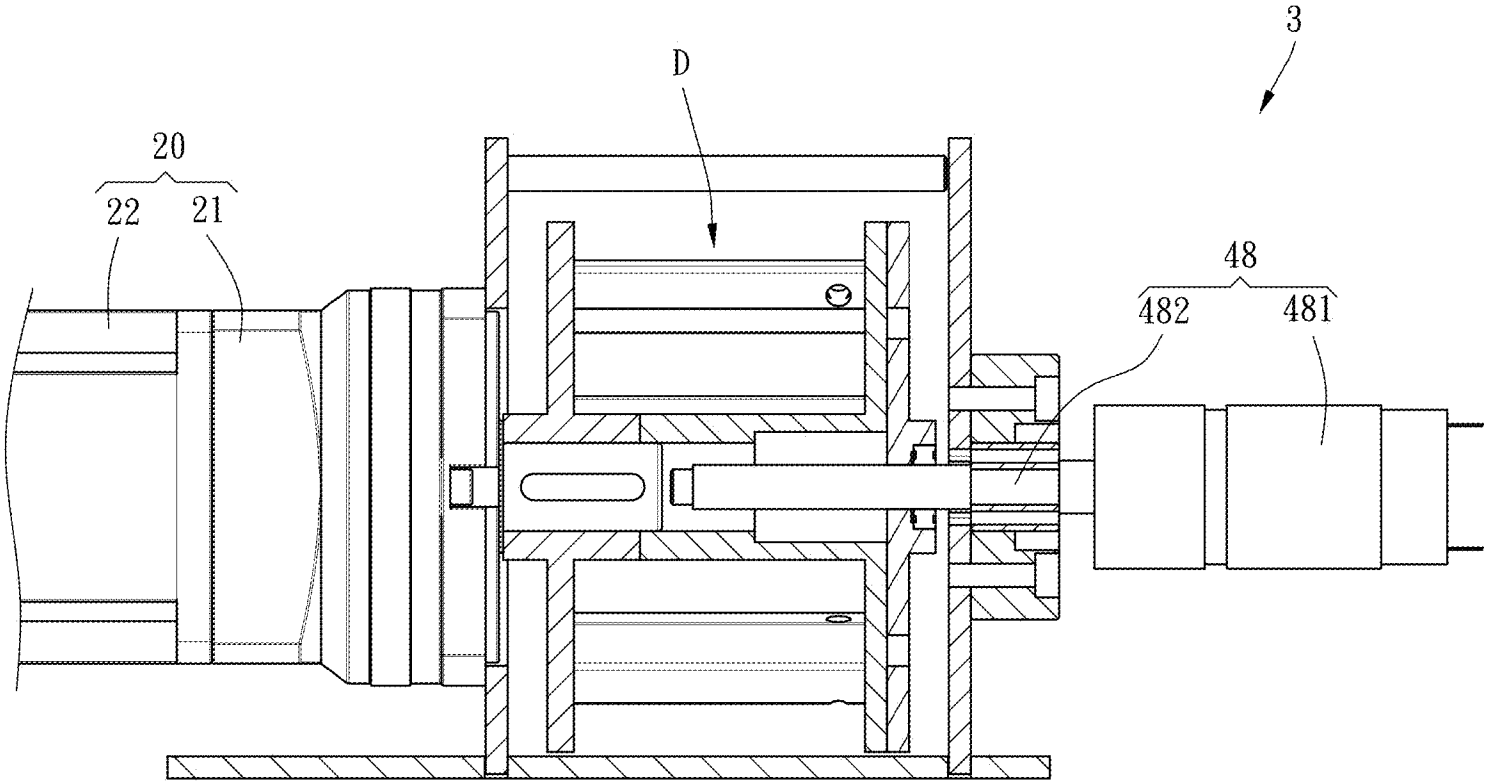
FIG. 19 is similar to FIG. 15, but the operation member thereof is a driving motor.

Besides, in this embodiment, the operation member 41 as shown in FIG. 15 may be replaced by the operation member 48 as shown in FIG. 19, i.e. the assembly of the motor 481 and the threaded rod 482, which can control the diameter of the cylinder D relatively more accurately to provide the user the required resistive force.

Further speaking, the drive unit 20 in the resistive force mechanism 2, 3 provided by the second and third embodiments of the present invention may be replaced by the multipole motor 23 as shown in FIG. 7 or the flywheel module 25 as shown in FIG. 8. Besides, the resistive force mechanism 2, 3 provided by the second and third embodiments of the present invention may be applied to the plank trainer 50 as shown in FIG. 9 and FIG. 10 or the multi-training machine 60 as shown in FIG. 11. The assembling manner and usage effect thereof are completely the same with the first embodiment, thereby not repeatedly mentioned here.

In conclusion, the drive unit 20 provided in the resistive force mechanism 1, 2, 3 of the present invention will output a fixed torque, and the torque is the result of multiplying the moment arm and the resistive force. Besides, the sliders 35 or 35' collectively form the cylinder D for the pulling cord R to be wound therearound. Therefore, the operation member 41, 48 is used to drive the moved member 44, 44', 44" to drive the sliders 35, 35' to leave or approach the axle portion 31 of the reel 30, making the diameter of the cylinder D increased or decreased so that the moment arm corresponding to the torque is increased or decreased. In this way, the resistive force mechanism 1, 2, 3 of the present invention can provide resistive force of different magnitude according to moment arm of different magnitude to result in enlarged resistive force adjustment range.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A resistive force mechanism comprising:

a drive unit;

a reel for a pulling cord to be wound therearound, wherein the reel comprises an axle portion driven by the drive unit to rotate, a first base plate disposed on the axle portion, a second base plate disposed opposite to the first base plate, and a plurality of sliders; and the sliders are annularly arranged around the axle portion, and movably disposed between the first and second base plates for leaving or approaching the axle portion; and an adjusting unit comprising an operation member rotatably disposed on the reel, and a moved member driven by the operation member to drive the plurality of sliders to leave or approach the axle portion;

wherein each of the first and second base plates has a plurality of guiding grooves; the plurality of guiding grooves are arranged annularly with respect to the axle portion and extend along radial directions of the axle portion; each of the plurality of sliders has two guiding pillars; the two guiding pillars of each of the plurality of sliders are movably inserted in the plurality of guiding grooves of the first and second base plates, respectively; when the plurality of sliders are driven by the moved member, the two guiding pillars of each of the plurality of sliders respectively slide along the plurality of guiding grooves of the first and second base plates to make the plurality of sliders leave or approach the axle portion; and wherein the moved member is disposed on the operation member, and the moved member is driven by the operation member to displace between the first and second base plates; the adjusting unit further comprises a plurality of linkages; an end of each of the plurality of linkages is pivotably connected with the moved member; another end of each of the plurality of linkages is pivotably connected with each of the plurality of sliders; the moved member is driven by the operation member to drive the plurality of linkages to swing in a way that the plurality of linkages respectively drive the plurality of sliders to leave or approach the axle portion.

2. The resistive force mechanism as claimed in claim 1, wherein the operation member has a threaded rod; the threaded rod is rotatably disposed on the axle portion of the reel; the moved member has a central threaded hole; and the threaded rod of the operation member is screwed into the central threaded hole of the moved member.

3. The resistive force mechanism as claimed in claim 2, further comprising a motor seat disposed on a periphery of the reel; the adjusting unit further comprises a positioning member fixed to the motor seat, and a connecting member accommodated in the positioning member; and the connecting member has a through hole for the threaded rod of the operation member to be inserted through the through hole.

4. The resistive force mechanism as claimed in claim 3, wherein the connecting member further has two sliding grooves; the adjusting unit further comprises two sliding pillars; an end of each of the two sliding pillars is fixed to the moved member, and another end of each of the two sliding pillars is movably disposed in each of the two sliding grooves of the connecting member, respectively; and when the two sliding pillars are driven by the moved member, the two sliding pillars respectively slide in the two sliding grooves relative to the connecting member.

* * * * *